United States Patent [19]

Buchman

[11] 4,037,663

[45] July 26, 1977

[54] METHOD FOR WELL EXPLOITATION

[76] Inventor: Smil Buchman, P.O. Box 9219, Tel Aviv, Israel

[21] Appl. No.: 299,674

[22] Filed: Oct. 24, 1972

[30] Foreign Application Priority Data

Dec. 17, 1971 Israel ..... 38393

[51] Int. Cl.[2] ..... E21B 43/00

[52] U.S. Cl. ..... 166/314; 415/202; 418/206

[58] Field of Search ..... 166/314, 315

[56] References Cited

U.S. PATENT DOCUMENTS

| | | | |
|---|---|---|---|
| 3,196,947 | 7/1965 | Van Poollen | 166/314 |
| 3,467,195 | 9/1969 | McAuliffe et al. | 166/314 |
| 3,548,946 | 12/1970 | Engle | 166/314 X |
| 3,643,740 | 2/1972 | Kelley | 166/314 |
| 3,705,532 | 12/1972 | Hubby | 166/314 X |
| 3,730,276 | 5/1973 | Land | 166/314 |

*Primary Examiner*—Ernest R. Purser
*Assistant Examiner*—George A. Suchfield
*Attorney, Agent, or Firm*—Benjamin J. Barish

[57] ABSTRACT

A method of extracting a liquid, such as oil, from an underground reservoir, is characterized by introducing a pump operated by extraneous energy into a well bore at a level which is below the dynamic level of the liquid therein, and operating the lift device to lift the liquid to the surface of the well bore while conserving the residual reservoir energy, i.e. the energy remaining which corresponds to that normally used in lifting the liquid from the lift device level to the dynamic level. The pump is one in which the liquid pressure at its inlet applies equal and opposite forces to the pump drive member so that the latter is driven solely by the external drive and does not dissipate the liquid reservoir energy existing at the pump inlet level. In this manner, the residual reservoir energy at the pump inlet level is exploited to increase the quantity of the liquid transported to the well bore. Optimumly, the lift device is applied at or close to the bottom of the well bore whereby substantially all of the reservoir energy is used to transport the liquid to the bottom of the well bore.

6 Claims, 5 Drawing Figures

FIG. 1
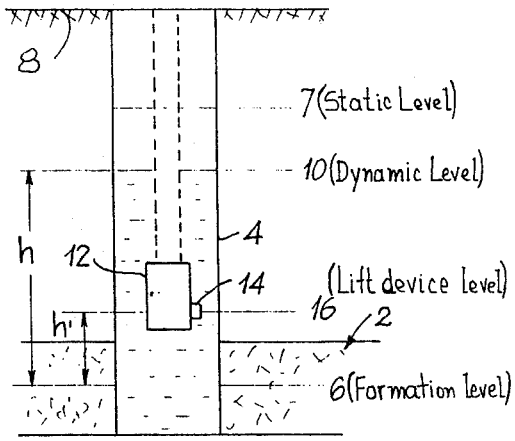
FIG. 2
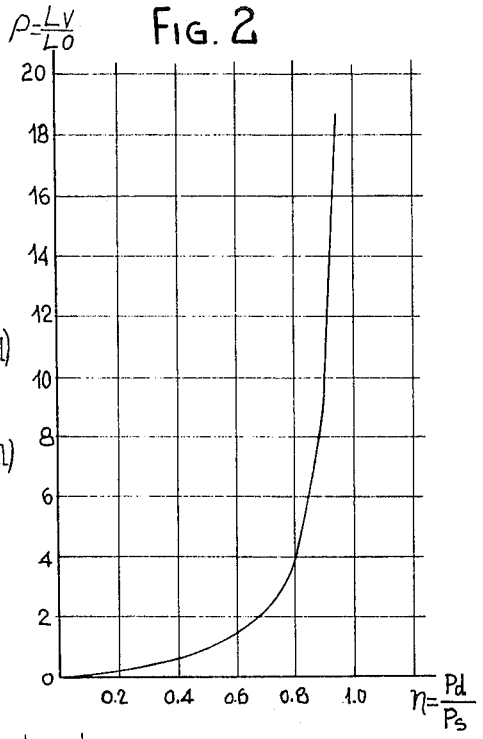
FIG. 3
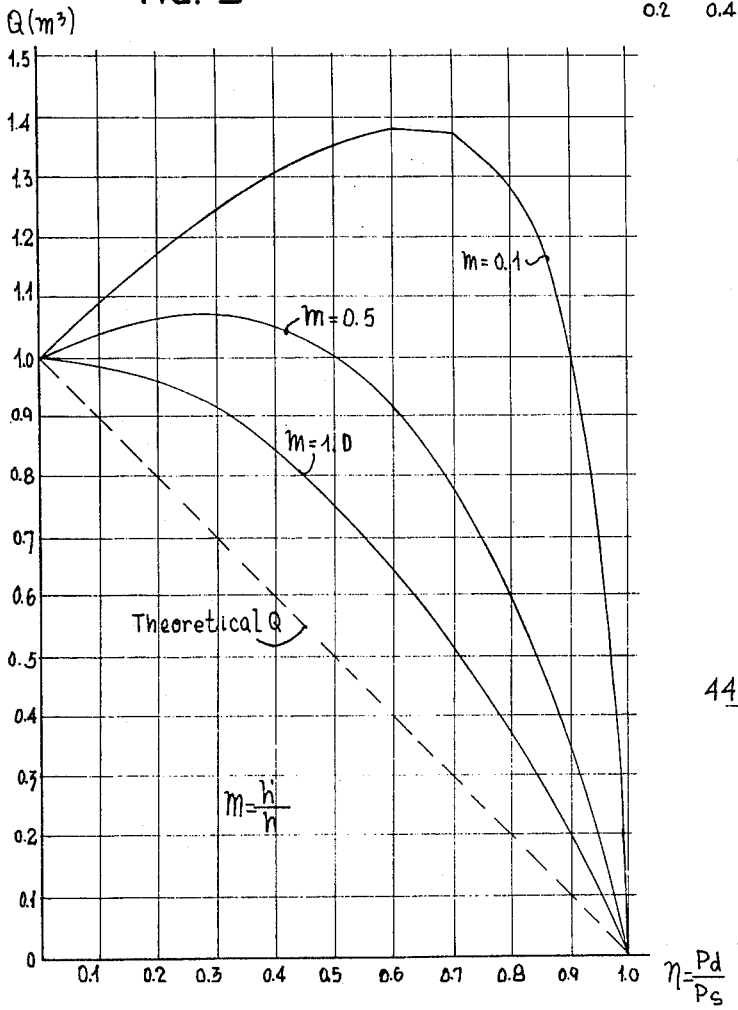
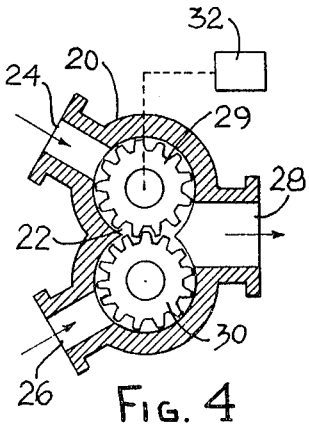
FIG. 4
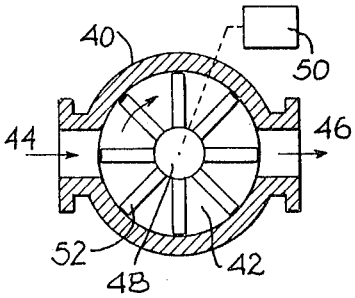
FIG. 5

METHOD FOR WELL EXPLOITATION

BACKGROUND OF THE INVENTION

The present invention relates to a method and apparatus for extracting a liquid from an underground reservoir. The invention is particularly applicable with respect to extracting oil from the ground, and is therefore described with respect to that application, but it will be appreciated that it would be used for extracting other liquids, for example water.

In one method of extracting oil from an underground reservoir, the reservoir energy is utilized to transport the liquid through the underground reservoir to the well bore, and then to raise the liquid in the well bore to a level, called the dynamic level. Conventional pumps are then operated to raise the liquid from the dynamic level to the surface.

The above method of extracting oil frequently results in the depletion of the reservoir energy before extracting all or even most of the oil, leaving a substantial percentage in the ground without natural propulsive energy. Secondary recovery methods may sometimes be used to extract additional oil, but these methods are expensive and not always commercially feasible.

SUMMARY OF THE PRESENT INVENTION

An object of the present invention is to provide a method of extracting a liquid, particularly oil, from an underground reservoir, which method exploits the natural reservoir energy to a greater extent in order to increase the rate and recovery of the liquid from the reservoir.

Another object of the invention is to provide novel pumps particularly useful in the above method.

According to the present invention, a lift device operated solely by extraneous energy is introduced into the well bore at a level below the dynamic level of the liquid and is operated to lift the liquid to the surface of the well bore while conserving the residual reservoir energy at the lift device level in the well bore. The lift device is a pump in which the liquid pressure at its inlet applies equal and opposite forces to the pump drive member. Accordingly, the drive member does not dissipate the liquid reservoir energy existing at the pump inlet level and is driven solely by the external drive. In this manner, the residual reservoir energy existing at the level of the pump inlet is conserved and is exploited to increase the quantity of the liquid transported to the well bore and thereby to increase the rate and the recovery of the well.

The description below sets forth the theoretical basis showing how the present invention enables the natural reservoir energy to substantially increase the liquid rate and recovery when compared to the known method briefly referred to above. As will also be shown in the description below, the theoretical optimum level for applying the lift device to lift the liquid to the surface of the well bore is at the bottom of the bore whereby substantially all of the reservoir energy is used for transporting the liquid to the well bore. However, advantages are still provided when the lift device is set at a higher level but below the dynamic level of the liquid as will be described more fully below.

The conventional lift systems, e.g. gas lift, plunger pumps, centrifugal pumps, and the like, used at the present time as the lift device for raising the liquid from the dynamic level, are not satisfactory in the present invention, since they do not conserve the reservoir energy but rather dissipate it. In other words, an important feature of the present invention is that the extraneous energy be applied at a point where there still remains substantial reservoir energy, and in such manner as to conserve that reservoir energy so that such energy will be available for the horizontal transport of the oil from the reservoir to the well bore.

According to further features of the invention, therefore, there are provided special pumps which may be used in this method, these pumps being constructed so as to be driven only by the extraneous drive means and not by the pressure of the reservoir at the level where the pump is applied.

Further features and advantages of the invention will be apparent from the description below.

BRIEF DESCRIPTION OF THE DRAWINGS

The invention is herein described, somewhat diagrammatically and by way of example only, with reference to the accompanying drawings, wherein:

FIG. 1 illustrates a method of extracting oil from an underground reservoir in accordance with the present invention;

FIG. 2 is a graph illustrating the ratio between the energy consumed by the vertical transport of the oil and the energy consumed by the horizontal transport of the oil in extracting the same from the underground reservoir;

FIG. 3 is a graph illustrating the relation of well output to different variables in accordance with the present invention;

FIG. 4 is a cross-sectional view of a novel gear pump useful in practicing the method of the present invention; and FIG. 5 is a cross-sectional view of a novel toothed-wheel pump useful in practicing the method of the present invention.

DESCRIPTION OF THE PREFERRED EMBODIMENT

FIG. 1 illustrates an oil reservoir 2 and a well bore 4 which has been drilled in order to extract the oil from the reservoir. The level 6 indicates the oil reservoir formation level and is taken approximately at the center of the oil formation 2. The static level of the oil is indicated at 7, this being the level to which it is raised by the natural reservoir pressure, i.e. the level assumed by the oil when no external pumping is applied. In the presently known method, a conventional pump or other externally powered lift device is used to lift the oil to the surface 8 of the well bore, the level assumed by the oil within the well bore when the pump is operated being called the dynamic level and being indicated at 10 in FIG. 1.

As indicated earlier, such conventional pumps do not conserve the residual reservoir energy of the oil existing at the level of the pump (i.e. its inlet) but rather dissipate this residual energy. That is to say, the pressure of the oil at the inlet to the pump tends to drive the pump (in addition to its normal drive), and therefore this residual energy is dissipated in the vertical lift of the oil in the well bore.

According to the present invention, a lift device is introduced into the well bore, below the dynamic level 10, and is operated to lift the oil to the surface of the well bore while conserving the residual reservoir energy at the lift device level in the well bore. In FIG. 1, the lift device is indicated at 12 and its inlet at 14. The lift device level is indicated at 16, it being on the axis of inlet 14. As indicated above and as will be shown more particularly below, the arrangement of the present invention better exploits the natural reservoir energy for increasing the rate and the recovery, the optimum results being theoretically obtainable when the lift device level 16 is at the bottom of the well bore 4, i.e. at formation level 6.

In order to show the importance of energy saving resulting from the oil extraction method as proposed by the present invention, a calculation is first made of the energy consumed for the horizontal transport of oil $Lo$ in the formation and also of the energy consumed for the vertical transport $Lv$, when using the known methods of oil extraction through bore-holes:

$$L_o = Q(P_s - P_d)$$

$$L_v = Qh\gamma$$

if:

$$h\gamma = p_d$$

$$n = P_d/P_s$$

the following is obtained:

$$L_o = Q\,P_s(1-n) \quad (1)$$

$$L_v = Q\,P_s n \quad (2)$$

where:

$Q$ = oil flow rate from the well (meters$^3$/hr)
$P_s$ = static pressure (kg/meters$^2$)
$P_d$ = dynamic pressure (kg/meters$^2$)
$h$ = height between dynamic level of oil and the formation level (meters)
$\gamma$ = density of oil (kg/meters$^3$)
$n$ = coefficient $0 \leqq n \leqq 1$ Equation (3) below points out the ratio between the two energies:

$$\rho = \frac{L_v}{L_o} = \frac{QP_s n}{QP_s(1-n)} \quad (3)$$

$$\rho = \frac{n}{1-n}$$

Under the usual conditions of exploitation, the values of $n$ are between 0.70–0.95. Thus, from equation (3) it is seen that the energy consumed for the vertical-transport ($L_v$) of oil is 2.3–19.0 times greater than the energy consumed for the horizontal transport ($L_o$), i.e. the expulsion of the oil from the formation into the bore-hole.

This is illustrated by FIG. 2, in which equation (3) is plotted, giving a general view of the energy ratios.

According to the method of the present invention, the reservoir energy is used mostly or completely to transport the oil through the formation to the bottom of the bore hole 4. Lift device 12 is located below the dynamic level 10 assumed by the oil, and preferably at or close to the bottom of the well bore (i.e. formation level 6) and applied extraneous energy at level 16 (the level of its inlet 14) in such manner as to conserve the residual reservoir energy.

In FIG. 1, dynamic level 10 (i.e. from formation level 6) is indicated as $h$, and the lift device level 16 (also from formation level 6) is indicated as $h'$. As will be shown below, the yield of the oil well increases as $h'$ decreases, the maximum theoretical yield being when the lift device level is at the bottom of the bore hole, i.e. at formation level 6.

To calculate the relationship between the flow rate and the developed and consumed energy, the following facts are utilized:

The variation of oil volume is proportional to the pressure variation.

The energy developed by the pressure drop of the oil during its expansion is equal to the energy consumed to expel the oil from the formation and then to lift it vertically.

In the relationships as given below, the following notations are used:

$\Delta V$ = variation of oil volume (meter$^3$).
$V$ = volume of oil from the draining zone of the well (meter$^3$).
$\Omega$ = horizontal surface area of oil (meter$^2$).
$P$ = pressure of the oil (kg/meter$^2$).
$P_s$ = static pressure of the oil in the formation (kg/meter$^2$).
$P_d$ = dynamic pressure of the oil in the well (kg/meter$^2$).
$E$ = elastic modulus of oil (kg/meter$^2$).
$\tau$ = work performed by the oil expansion (kg. meter).
$L_o$ = work consumed by expelling the oil from the formation (kg. meter).
$L_v$ = work consumed by the vertical transport of liquid (kg. meter).
$L$ = height (meter).
$h$ = dynamic level of liquid measured from the formation level (meter).
$h'$ = the height to which the formation pressure itself effectively pushes the oil measured from the formation level (meter).
$Q$ = quantity of oil obtained (meter$^3$).

The variation of oil volume during its expansion is expressed as follows:

$$\Omega\Delta L = PL\Omega/E$$

where:

$$\Omega\Delta L = \Delta V$$

$$\Omega L = V$$

thus:

$$\Delta V = PV/E$$

The energy developed by the oil expansion is:

$$\tau = F\Delta L = \frac{P\Omega}{2} \cdot \frac{PL}{E}$$

Taking into account that the pressure varies from $P_s$ to $P_d$, the following is obtained:

$$\tau = \frac{VP_s 2}{2E}(1 - n^2)$$

Equating the energy given off and the energy consumed the result is:

$$\tau = L_o + L_v$$

$$L_0 = Q\,P_s(1 - n)$$

$$L_v = Q\,h'\,\gamma$$

$$\frac{VP_s2}{2E}(1 - n^2) = QP_s(1 - n) + Qh'\,\gamma$$

wherefrom the flow rate of the well is obtained, taking into account that:

$$h\,\gamma = P_d$$

$$h'\,\gamma = mP_d$$

$$m = \frac{h'}{h}\quad 0<m\leqq 1 \tag{4}$$

$$Q = \frac{VP_s(1 - n^2)}{2E\,[1 + n\,(m - 1)]}$$

Equation (4) which gives the well output is original and represents the theoretical basis of the method proposed by this invention.

By examining the variation of well output versus ratio $m$ between the effective lifting height $h'$ of the oil and the height $h$ of the dynamic level, it is established that:

The well output is minimum when $m = 1$, which means when the height $h'$ up to which the formation effectively pushes the oil vertically, is equal to height $h$ of the dynamic level. This is the method by which the wells are presently exploited.

The well rate reaches a maximum if $0<m\simeq 0$, i.e. if $0<h'\simeq 0$, that is the case when the formation does not lift the oil vertically. This is the manner of exploitation foreseen by the present invention and the theoretical justification is given by equation (4).

In FIG. 3 Equation (4) of the output rate versus $n$ and $m$ is represented graphically. On the graph there is also plotted the curve corresponding to the presently generally accepted assumption according to which the output is directly proportional to the pressure difference:

$$Q = K\,(P_s - P_d)$$

$$Q = K\,P_s(1 - n)$$

On the graph, this curve is designated as theoretical Q, as known up to now.

From this graph it can be seen that for the current pressure ratios $n = 0.7 - 0.95$, substantial increases of output are obtained by the method according to the present invention.

| Pressure ratio n | 0.7 | 0.8 | 0.9 |
|---|---|---|---|
| Output by methods generally used m = 1 | 0.51 | 0.36 | 0.19 |
| Output obtained by using the method according to the present invention m = 0.1 | 1.38 | 1.29 | 1.00 |

A practical check of equation (4) was made in several oil wells and water wells and it was confirmed that it corresponds perfectly to the results obtained.

Equation (4) for the output holds true only when $P_s =$ constant.

The following example shows the measurements obtained in an output test from an oil well:

| $P_s$ | $P_d$ | $n = \frac{P_d}{P_s}$ | Q | χ | χQ |
|---|---|---|---|---|---|
| (psi) | (psi) | — | ($m^3$/day) | — | ($m^3$/day) |
| 3150 | 3070 | 0.975 | 100 | 0.00050 | 0.050 |
| 3150 | 3000 | 0.954 | 190 | 0.00050 | 0.095 |
| 3150 | 2880 | 0.917 | 310 | 0.00050 | 0.155 |

If the flow rate Q of the well is plotted on the graph of FIG. 3 at the respective $n$, it is found that all the points are on a curve which is rigorously parallel to curve $m = 1$.

To avoid the graphic translation of the output curve, the following analytical procedure is taken: the output is multiplied by a constant factor X, thus obtaining a reduced flow-rate XQ, which is plotted on the graph at the respective $n$.

To determine the constant X the curve $m = 1$ on the graph of FIG. 3 is followed until the flow rate corresponds to one of the measurements made in the well, for example:

taking $n = 0.975$ is found that $Q = 0.050$ then $$\chi = \frac{0.050}{100} = 0.00050$$

Equation (4) of the well output permits the determination of the drainage radius of the well, when the formation porosity is $p$.

$$V = \pi\,r^2\,L\,p$$

$$V = \frac{2QE[1 + n\,(m - 1)]}{P_s(1 - n^2)} = \pi r^2\,Lp$$

Thus:

$$r = \sqrt{\frac{2QE\,[1 + n\,(m - 1)]}{\pi LpP_s(1 - n^2)}}$$

$r$(meter) = drainage radius of the well $p$ (%) = formation porosity

The final recovery index for the oil from the reservoir is calculated in the following way:

By comparing the total quantity of oil extracted in the same period $t$ with the known methods $M_l$ to the total quantity of oil extracted by the method $M_m$ according to the present invention, taking into account that initially the quantity of the reservoir oil is the same, one can estimate the efficiency of the two methods:

$$M_l = Q_l\,t$$

$$M_m = Q_m\,t$$

wherefrom:

$$\eta = \frac{Q_m}{Q_l} = \frac{M_m}{M_l}$$

By the substitution of Q from Equation (4) the following equation is obtained:

(6)

-continued $$\eta = \frac{M_m}{M_1} = \frac{1}{1 + n(m - 1)}$$

Equation (6) shows that the total quantity of oil extracted by the method according to the invention in which $0 < m < 1$ is always greater than the total quantity obtained by methods used up to now in which $m = 1$.

When $n = 0.7$–$0.9$ and $m = 0.1$, then $\eta = 2.70$–$5.26$.

Thus from the reservoir at $m = 0.1$, a quantity of oil approximately 3.5 times greater can be extracted by the method according to the invention than the quantity of oil extracted by the methods used up to now.

It has been found that by the methods used up to now 20–25% can be extracted from the initial reservoir oil in the entire life of an oil well, whereas through the extraction method proposed by this invention, approximately 75–85% is extracted.

Thus, if the well exploitation is made by the method according to the present invention, secondary recovery methods are not necessary, because from the beginning 75–85% of the reservoir oil is extracted.

As indicated earlier, it is necessary that the lift device 12 apply its external lift energy in such manner that the residual reservoir energy existing at that level in the well bore (i.e. residual over and above the reservoir energy utilized in transporting the oil from the reservoir itself) be conserved and not be dissipated. In this way, this residual reservoir energy is exploited to increase the quantity of the oil transported horizontally from the formation level to the bottom of the well bore.

FIG. 4 illustrates a gear pump that may be ued for applying this extraneous lift at level 16 in the manner described above.

As shown in FIG. 4 the gear pump comprises a housing 20 containing an internal chamber 22, a pair of inlets, 24, 26 leading into the chamber, and an outlet 28 leading out from the chamber. Outlet 28 is parallel to the longitudinal axis of the chamber, whereas the two inlets 24, and 26 are disposed on each side of the longitudinal axis of the chamber. The chamber 22 includes a pair of meshing gears 29, 30, the axis of rotation of each gear being in alignment with the longitudinal axis of one of the inlets. Further, a drive 32 is mechanically coupled to drive one of the gears, e.g. 29, which, being meshed with the other gear, also drives it, the two gears being driven in the directions shown by the arrows.

It will be seen that pressure of the oil at the two inlets 24, 26 will apply equal and opposite forces to the meshing gears 29, 30 and therefore these gears will not be rotated by this oil pressure. That is, the pump will not consume or dissipate the reservoir energy at level 16 of the well bore. The only energy that will rotate the gears is that applied by the external drive 32.

FIG. 5 illustrates another pump that could be used, this being a toothed-wheel type pump. The pump of FIG. 5 includes a housing 40 containing a chamber 42 of circular cross-section and having an inlet 44 and an outlet 46. A wheel 48 is rotatably mounted in chamber 42 on an axis of rotation concentric with the axis of the circular-section chamber 42, and a drive 50 rotates wheel 48. Wheel 48 includes a plurality of teeth 52, fixed thereto and all of the same fixed dimension so as to contact the inner surface of chamber 42 as the wheel is rotated. The oil is expelled from the pump by centrifugal force.

It will be seen that the pressure of the oil at the inlet 44 is applied to the teeth 52 equally and in opposite directions, whereby wheel 48 is driven only by drive 50 and not by the pressure of the oil.

The pump of FIG. 5 is preferably used where high pressures and/or narrow spaces are involved.

The pumps of FIGS. 4 and 5 could constitute the first stage of a more conventional pump, such as a centrifugal pump or the like.

Many other variations, modifications and applications of the illustrated embodiments will be apparent.

What is claimed is:

1. A methd of pumping a liquid from a well bore communicating with an underground reservoir, the reservoir energy being used to transport the liquid from the reservoir to the well bore, characterized in introducing into the well bore a pump having a drive member, an external drive therefor, an inlet, and an outlet, the inlet being disposed at a level in the bore which is below the dynamic level of the liquid therein, the pump being such that the pressure of the liquid at the inlet applies equal and opposite forces to the pump drive member so that the latter is driven solely by the external drive and does not dissipate the liquid reservoir energy at the pump inlet level; and operating said pump to lift the liquid to the surface of the well bore solely by the external drive while conserving the reservoir energy at the pump inlet level in the well bore for increasing the rate and quantity of the liquid transported from the underground reservoir to the well bore by said reservoir energy.

2. The method as defined in claim 1, wherein said pump inlet is disposed substantially below said dynamic level, the quantity of liquid extracted being represented by the formula:

$$Q = \frac{VP_s(1 - n^2)}{2E[1 + n(m - 1)]}$$

wherein $Q$ = quantity of liquid extracted from the well (meters$^3$)

$V$ = volume of liquid from the draining zone of the well (meters$^3$)

$n = Pd/Ps$ $0 \leq n \leq 1$ $E$ = elastic modulus of liquid (kg/meters$^2$)

$m = (h'/h)$ $0 < m \leq 1$ $h$ = height (meters) of the dynamic level measured from the formation level $h'$ = height (meters) of the extraneous energy level measured from the formation level $P_d$ = dynamic pressure of the liquid at the bottom of the bore hole (kg/meters$^2$)

$P_s$ = static pressure of the liquid in the formation (kg/meters$^2$)

3. The method as defined in claim 1, wherein said pump inlet is disposed substantially at the bottom of the well bore, whereby substantially all of the reservoir energy is exploited for transporting the liquid from the reservoir to the well bore.

4. The method as defined in claim 1, wherein said drive member of the pump is a rotary drive member, and is disposed such that it is subjected to equal and opposite forces by the pump inlet pressure.

5. The method as defined in claim 4, wherein said pump is a gear pump having a housing containing a chamber, a pair of inlets leading into the chamber, there being one inlet on each side of the longitudinal axis of the chamber, an outlet from the chamber, a pair of meshing gears disposed in the chamber, the axis of rotation of each gear being in alignment with the longitudinal axis of one of said inlets, and a drive for driving said meshing gears, the pressure of the liquid at the two inlets being applied to the gears equally in opposite directions, whereby the gears are driven only by said drive and not by the pressure at said inlets.

6. The method as defined in claim 4, wherein said pump is a toothed-wheel pump including a housing containing a chamber of circular cross-sections and having an inlet and an outlet, a wheel rotatably mounted in said chamber on an axis of rotation concentric with the axis of the circular-section chamber, a drive for driving said wheel, said wheel having a plurality of teeth fixed thereto and all of the same fixed dimensions to contact the inner surface of the chamber as the wheel is rotated, whereby the pressure of the liquid at said inlets is applied to the teeth equally in opposite directions so that the wheel is driven only by said drive and not by the pressure at said inlets.

* * * * *